US006921435B2

(12) United States Patent
Yasuda et al.

(10) Patent No.: US 6,921,435 B2
(45) Date of Patent: Jul. 26, 2005

(54) APPARATUS AND METHOD FOR COATING ELECTRO-PHOTOGRAPHIC SENSITIVE MEMBERS, AND ELECTRO-PHOTOGRAPHIC SENSITIVE MEMBERS MADE THEREBY

(75) Inventors: Kenichi Yasuda, Hachioji (JP); Nobuaki Kobayashi, Hachioji (JP); Tadaaki Sumitani, Hachioji (JP)

(73) Assignee: Konica Corporation (JP)

( * ) Notice: Subject to any disclaimer, the term of this patent is extended or adjusted under 35 U.S.C. 154(b) by 38 days.

(21) Appl. No.: 10/207,524

(22) Filed: Jul. 29, 2002

(65) Prior Publication Data

US 2003/0037727 A1 Feb. 27, 2003

(30) Foreign Application Priority Data

Aug. 10, 2001 (JP) ..... 2001-243713
Aug. 15, 2001 (JP) ..... 2001-246530

(51) Int. Cl.[7] ..... B05C 19/02
(52) U.S. Cl. ..... 118/423; 118/412
(58) Field of Search ..... 118/63, 423, 602, 118/64, 66, 412, 429; 427/430.1, 384, 432

(56) References Cited

U.S. PATENT DOCUMENTS 3,632,411 A * 1/1972 Stark
6,010,572 A * 1/2000 Furusawa et al.

FOREIGN PATENT DOCUMENTS

| | | | |
|---|---|---|---|
| JP | 1-107874 | * | 4/1989 |
| JP | 3-213171 | * | 9/1991 |
| JP | 9218525 | | 8/1997 |
| JP | 9-218525 | * | 8/1997 |
| JP | 10-20525 | * | 1/1998 |

OTHER PUBLICATIONS

Translation of 9–218525 (English) (9 pages).

* cited by examiner

*Primary Examiner*—Brenda A. Lamb
(74) *Attorney, Agent, or Firm*—Muserlian, Lucas and Mercanti

(57) ABSTRACT

A coating apparatus for a plurality of cylindrical light sensitive members each for use in an electrophotography, is provided with a coating tank in which a coating liquid is stored; a dipping device to lift down the plurality of cylindrical base members into the coating liquid and to lift up the plurality of cylindrical base members above the coating liquid so that the plurality of cylindrical base members are coated with the coating liquid; and a plurality of drying hoods corresponding in number to the plurality of cylindrical base members and provided above the coating tank so that each of the plurality of cylindrical base members is lifted up from the coating tank into a respective drying hood among the plurality of cylindrical base members.

23 Claims, 4 Drawing Sheets

APPARATUS AND METHOD FOR COATING ELECTRO-PHOTOGRAPHIC SENSITIVE MEMBERS, AND ELECTRO-PHOTOGRAPHIC SENSITIVE MEMBERS MADE THEREBY

BACKGROUND OF THE INVENTION

The present invention relates to an apparatus of coating electro-photographic sensitive members, a method of coating electro-photographic sensitive members by said apparatus, and electro-photographic sensitive members prepared by said coating method, and particularly, in manufacturing of electro-photographic sensitive members, to a coating apparatus of forming an organic photo-sensitive layer on the outer surface of a cylindrical base member, a coating method of using said coating apparatus, and electro-photographic photo-sensitive member.

Conventionally, inorganic compounds such as selenium, cadmium sulfide, and zinc oxide and organic compounds such as polyvinyl carbazole have been proposed as photoconductive materials constituting a photosensitive layer on an electro-photographic sensitive member. For multi-layer electro-photographic sensitive members each of which has a photosensitive layer, a charge generation layer, and a charge transfer layer, various organic compounds have been proposed as charge generating materials and charge transferring materials and have been actually used for organic photosensitive members. Conventionally, these organic photosensitive members have been made by various coating methods such as dipping, spraying, spinning, beading, wire-bar, blade, roller, extrusion, and curtain methods. Particularly, the dipping coating method has been widely used to form uniform photo-sensitive layers on the outer surface of a cylindrical base member.

Recently, demands have been increasing to make apparatus using an electro-photographic photo-sensitive member such as duplicating machines, printing machines, facsimile machines smaller and less weighted. To meet the demands, the electro-photographic photo-sensitive members have been made smaller and less weighted. Particularly, as a method for manufacturing cylindrical electro-photographic photo-sensitive members of smaller diameters, Japanese Non-examined Patent Publications H05-88385 and H06-262113 disclose methods of simultaneously dipping a plurality of cylindrical base members into a coating liquid and pulling them up at the same time. This simultaneous multi-cylinder dipping method has been widely used judging from the point of improvement of productivity. This method becomes more effective and increases the productivity when the cylindrical base member are closely arranged. In this case, solvent vapor evaporating from the coated films on the substrata and from the surface of the coating liquid in the bath when the substrata are pulled up will make the film dry-up speeds different among cylindrical base member or among surface areas of respective cylindrical base member. This will make film thickness uneven on the substrata. To prevent this, Japanese Non-examined Patent Publications 59-127049 discloses a method comprising the steps of feeding air from the outside to the liquid container and its vicinity to reduce the concentration of solvent vapor near the liquid container before the cylindrical base member are pulled up and drying up the films faster. Further, Japanese Non-examined Patent Publication H03-000151 discloses a method of providing ports for exhausting solvent vapor near the liquid container, connecting these ports to a forced exhaust apparatus having an ON/OFF mechanism, controlling the concentration of solvent vapor near the cylindrical base member while the substrata are pulled up, and thus suppressing unevenness of film thickness.

However, the above technologies are not effective to make the concentration of the solvent vapor uniform near the air supply ports and near the ports for exhausting solvent vapor because the concentration of solvent vapor is smaller near the air supply ports and near the vapor exhausting ports connected to the forced exhaust apparatus but higher away from them.

In other words, the conventional technologies are not satisfactory to solve the above problem that the solvent vapor concentration is uneven near cylindrical base member in the dip-coating. In the conventional technologies, solvent vapor densities are different on the coated surfaces of the cylindrical base member. These uneven vapor densities are apt to cause uneven dry-up speeds and finally uneven thickness of coated layers.

Particularly, in dip coating by the apparatus of simultaneously coating a plurality of cylindrical base member, each cylindrical base member has uneven solvent vapor concentration around it and different dry-up speed. Consequently, each base member has an uneven layer thickness and a leading thin coat area. This also causes reduction in productivity.

To prevent the above-mentioned uneven solvent vapor densities, Japanese Non-examined Patent Publication H08-220786 discloses a method of uniforming the solvent vapor densities over the coating liquid surface by providing vapor exhausting ports in the recycle tube and below the coating liquid level and using a solvent whose specific gravity is greater than that of air and whose saturated vapor concentration is comparatively low. However, this method using solvent of low saturated vapor concentration is slow in drying up the coated layers. Accordingly, the coated layer is apt to move down before the coated layer is dried up to be non sticky to fingers. Consequently, each cylindrical base member has a thinner coated film on the top of the cylinder and a thicker coated film on the bottom of the cylinder. This results in the uneven layer thickness. This uneven layer thickness is apt to occur in a thin coated layer such as a charge generation layer and so on.

SUMMARY OF THE INVENTION

It is an object of the present invention to solve such problems that are found in the conventional technologies. In other words, a first object of the present invention is to provide an electro-photographic sensitive member coating method of forming a photo-sensitive layer of an even thickness on the surface of each of cylindrical base members by dip-coating for simultaneously coating a plurality of cylindrical base members and to provide electro-photographic sensitive members prepared by said coating method. A second object of the present invention is to provide an apparatus of coating electro-photographic sensitive members with a film of an almost identical thickness by exhausting solvent vapor which evaporates from the coated films on the substrata and from the surface of the coating liquid in the bath (tank) as uniformly as possible around the cylindrical base member, even if using a high saturated vapor density solvent such as methylene chloride, while the base member are being pulled up even in coating of a thin layer such as a charge generation layer whose thickness is 1 $\mu$m when dried-up.

The first object of the present invention can be attained by giving the configuration below to the apparatus.

(1-1) An electro-photographic sensitive member coating apparatus of simultaneously dipping a plurality of cylindrical base member in a coating liquid, pulling out the plurality of cylindrical base member, and thus forming a coat on each of the plurality of cylindrical base member, wherein said apparatus is equipped with as many drying hoods as said plurality of cylindrical base member to cover each of them.

(1-2) The electro-photographic sensitive member coating apparatus in accordance with (1-1), wherein each of said drying hoods is bigger than said cylindrical base member so that said cylindrical base member can pass through said drying hood with a clearance of 1/10 to 1 of the diameter of said substrata between said substrate and said drying hood.

(1-3) The electro-photographic sensitive member coating apparatus in accordance with (1-1) or (1-2), wherein said drying hood has a plurality of through-holes to pass gaseous materials.

(1-4) The electro-photographic sensitive member coating apparatus in accordance with (1-3), wherein the opening of each of said through-hole is 0.1 to 10 mm in diameter.

(1-5) The electro-photographic sensitive member coating apparatus in accordance with (1-3) or (1-4), wherein the ratio of the whole opening area of said through-holes (to the whole area of the drying hood) is 5 to 50%.

(1-6) A method of coating electro-photographic sensitive members, comprising the steps of using an electro-photographic sensitive member coating apparatus in accordance with any of (1-1) through (1-5), simultaneously dipping a plurality of cylindrical base member in a coating liquid, simultaneously pulling out from the coating liquid, and thus forming a coat on each of the substrata.

(1-7) The method of coating electro-photographic sensitive members in accordance with (1-6), wherein the coat on said cylindrical base member is 5 to 300 $\mu$m thick.

(1-8) The method of coating electro-photographic sensitive members in accordance with (1-6) or (1-7), wherein said coating liquid is for formation of charge generation layers.

(1-9) An electro-photographic sensitive member prepared by said electro-photographic sensitive member coating method in accordance with any of (1-6) through (1-8).

The second object of the present invention can be attained by giving the configuration below to the apparatus.

(2-1) An electro-photographic sensitive member coating apparatus of dipping a cylindrical base member in a coating liquid, pulling out the cylindrical base member, and thus forming a coat on the cylindrical base member; comprising a bath for storing a coating liquid, a solvent vapor chamber above said bath, and a drying hood above said solvent vapor chamber, wherein said solvent vapor chamber covers the whole space above said bath and exhaust ports are provided between the solvent vapor chamber and the drying hood over the chamber.

(2-2) The electro-photographic sensitive member coating apparatus in accordance with (2-1), wherein the clearance of each of said exhaust ports is 0.1 to 10 mm wide.

(2-3) The electro-photographic sensitive member coating apparatus in accordance with (2-2), wherein the opening of said exhaust port is 50 to 100% to the peripheral length of the drying hood.

(2-4) The electro-photographic sensitive member coating apparatus in accordance with any of (2-1) to (2-3), wherein a recycle tube is connected to said solvent vapor chamber to feed back the overflowing liquid for recovery.

(2-5) A method of coating electro-photographic sensitive members by said electro-photographic sensitive member coating apparatus in accordance with any of (2-1) through (2-4), wherein solvent vapor is being exhausted through said exhaust ports while coats are formed on cylindrical base member.

(2-6) The method of coating electro-photographic sensitive members in accordance with (2-5), wherein the coats formed on said cylindrical base member by dipping are 30 to 300 $\mu$m thick.

(2-7) The method of coating electro-photographic sensitive members in accordance with (2-5) or (2-6), wherein the solvent for said coating liquid has a saturated vapor pressure (at 24° C.) of 6.5 to 80 kPa.

(2-8) The method of coating electro-photographic sensitive members in accordance with any of (2-5) through (2-7), wherein a plurality of cylindrical base member are simultaneously dipped in a coating liquid and pulled up from the liquid to form a coat on each of the substrata.

(2-9) The method of coating electro-photographic sensitive members in accordance with any of (2-5) through (2-8), wherein said coating liquid is for formation of charge transfer layers.

(2-10) An electro-photographic sensitive member prepared by said electro-photographic sensitive member coating method in accordance with any of (2-5) through (2-9).

DETAILED DESCRIPTION OF THE PREFERRED EMBODIMENT

Below will be explained the system configuration which attains the first object of the present invention.

Figure 1:
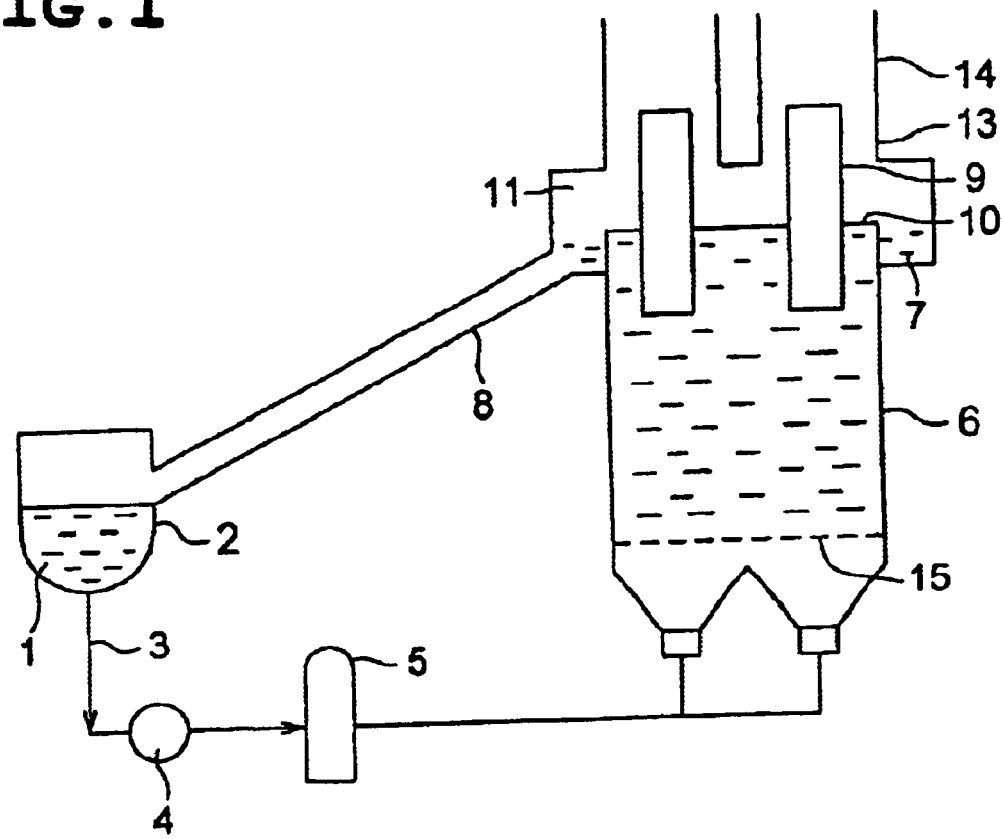
FIG. 1 is a system block diagram of a simultaneous multi-cylinder dip-coating apparatus which is an embodiment of the present invention.
Figure 2:
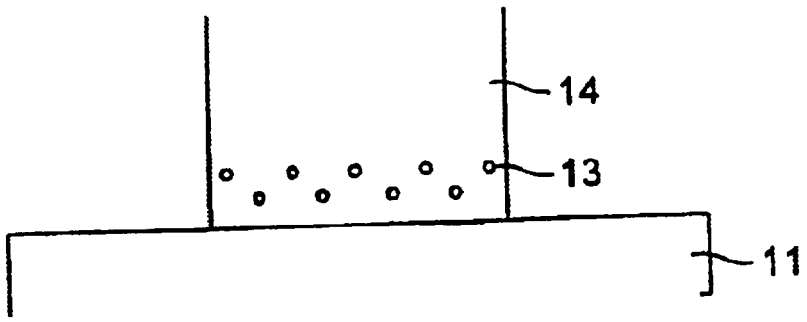
FIG. 2 shows through-holes made on a drying hood.

FIG. 1 shows a system block diagram of a simultaneous multi-cylinder dip-coating apparatus which is an embodiment of the present invention. In this figure, cylindrical base member are now being pulled up from the coating liquid. The apparatus in FIG. 1 is equipped with a solvent vapor chamber 11 over the coating liquid bath 6 to block air coming from the outside and separate drying hoods 14 over said solvent vapor chamber 11. When pulled up from the coating liquid bath 6, the cylindrical base member enter the solvent vapor chamber 11 to let the coated films on the substrata emit a lot of solvent vapor, and then enter the separate drying hoods 14 to be dried up. It is preferred that the present invention provides through-holes 13 on each of the drying hood 14 as shown in FIG. 2.

The solvent vapor chamber covering the coating liquid bath works to hold solvent vapor evaporating from the coating liquid and the coated films and keep the concentration of the solvent vapor constant. The through-holes are provided between the solvent vapor chamber and each drying hood to encircle the coated base member which is being pulled up. Each of the drying hoods is constructed to surround the cylindrical base member.

The coating liquid 1 is transferred by force by the pump 4 from the coating liquid tank 2 to the coating liquid bath 6 through the supply pipe 3 and the filter 5. The coating liquid bath 6 has a mesh 15 in the lower part of the bath to uniform the velocity of the coating liquid in the bath. The coating liquid supplied into the coating liquid bath 6 overflows down to the coating liquid conduit 7 which is provided on the lower part of the solvent vapor chamber 11, runs into the recycle tube 8, and goes back to the coating liquid tank 2. This liquid circulating means transfers the coating liquid in loop during dip-coating to keep the level 10 of the coating liquid in the coating liquid bath constant irrespectively of whether the cylindrical base member are dipped in the bath or pulled up from the bath.

A conventional apparatus for simultaneously dip-coating a plurality of cylindrical base member has been equipped with a large drying hood 14 (hereinafter called a large drying hood) which works as both a solvent vapor chamber and a drying hood and covers all of said cylindrical base member. However, this structure is not effective to uniformly reduce the concentration of solvent vapor in the drying hood. Further, it is difficult for this structure to uniformly reduce the concentration of solvent vapor around each base member. Consequently, this structure has been apt to cause the cylindrical base member to have uneven coat thicknesses and increase a leading thin coat area.

Referring to FIG. 1, the present invention separates the drying hood from the solvent vapor chamber and provides as many drying hoods as the cylindrical base member. This structure can make the drying conditions of the cylindrical base member identical and uniformly reduce the concentration of solvent vapor in the drying hoods. This can eliminate uneven coat thicknesses, leading thin coat area, and dispersion in characteristics of the photo-sensitive materials.

It is preferred that said drying hood is cylindrical and wide enough to let a cylindrical base member pass through it. In other words, the clearance between the drying hood and the cylindrical base member should be preferably 1/10 to 1 of the diameter of said substrata. If this ratio is less than 1/10, the cylindrical base member may touch the drying hood and lose part of the coat when the base member passes through the hood.

If this ratio is greater than 1, the apparatus singly becomes bigger and the productivity will not be improved. The opening of each through-hole is preferably 0.1 to 10 mm. If the hole opening is smaller than 0.1 mm, the solvent vapor is apt to remain stagnant in the drying hood. Contrarily if the hole opening is bigger than 10 mm, the solvent vapor in the hood is apt to be disturbed by air coming from the outside.

Further, the drying hood preferably has a number of through-holes. The ratio of the total opening area of said through-holes (to the whole area of the drying hood) is preferably 5 to 50%. If this ratio is less than 5%, the solvent vapor is apt to remain stagnant in the drying hood. If this ratio is more than 50%, the solvent vapor in the hood is apt to be disturbed by air coming from the outside.

The preferred length of the drying hood is 5 to 300 cm. If the length is shorter than 5 cm, the drying hood has little effect to eliminate uneven coat thicknesses. If the length is longer than 300 cm, the effect of the drying hood does not offset the large dimensions of the apparatus.

The present invention should be preferably equipped with a solvent vapor chamber under the drying hood and above the coating liquid bath. The drying hood should be preferably 1 to 100 cm high above the coating liquid surface. In other words, if this height is less than 1 cm, the space of the solvent vapor chamber is too narrow to stabilize the film on the cylindrical base member immediately after coating. If the height is greater than 100 cm, the effect of the solvent vapor chamber does not offset the large dimensions of the apparatus.

Further, it is preferred that an exhaust port is provided between the solvent vapor chamber and the drying hood. This port exhausts solvent vapor to make the concentration of solvent vapor identical in the whole solvent vapor chamber, make the dry-up speed of the coats identical immediately after coating, and eliminate unevenness in coat thickness in the circumferential direction of the cylindrical base member.

Said exhaust port should be preferably provided between the solvent vapor chamber and the drying hood with a clearance of 0.1 mm to 10 mm therebetween. If the clearance is less than 0.1 mm, the solvent vapor is not exhausted sufficiently. If the clearance is more than 10 mm, the solvent vapor in the chamber is apt to be disturbed by air coming from the outside and the concentration of the solvent vapor in the chamber is apt to be non-uniform.

Said solvent vapor chamber has openings (holes) to let cylindrical base member pass through them. The openings are preferably circular as well as the cylindrical base member.

Said drying hood should be preferably designed to dry the coats by natural gas flow. If a dry air is forcibly fed into the drying hood, the wet coat in the drying hood may be uneven and increase a leading thin coat area.

Figure 3:
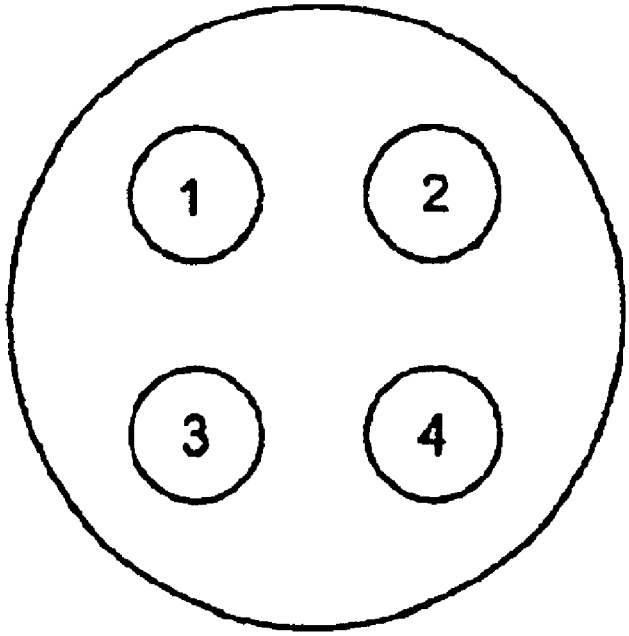
FIG. 3 is a top view of the arrangement of four cylindrical base member to be dip-coated simultaneously.
Figure 4:
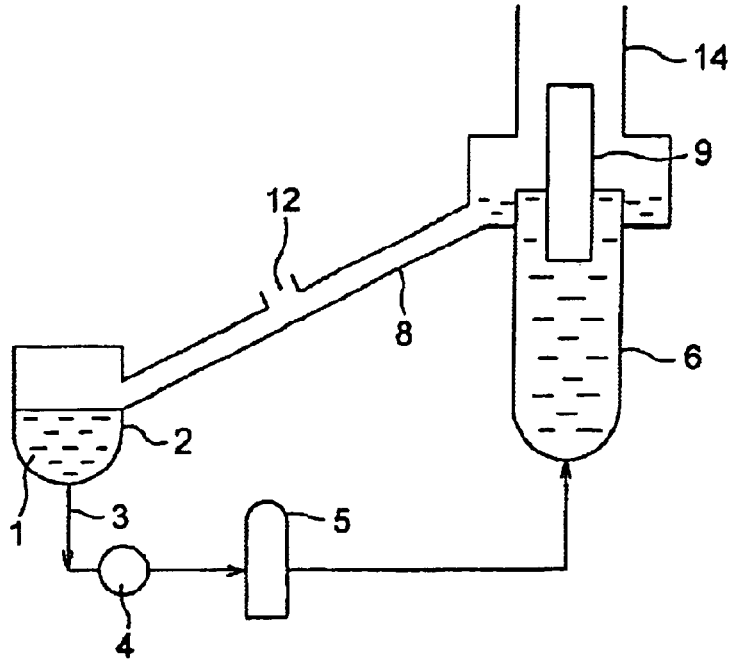
FIG. 4 is a system block diagram of the multi-cylinder dip-coating apparatus whose recycle tube has a solvent vapor exhaust port in the recycle tube and below the liquid level of the coating liquid bath.

To simultaneously form even coats on outer surfaces of a plurality of cylindrical base member, the drying conditions of the cylindrical base member should be preferably identical. Therefore, it is preferred that the cylindrical base member is arranged in the same manner. FIG. 3 shows a preferred arrangement of four cylindrical base member for simultaneous dip-coating.

As explained above, the apparatus of the present invention can exhaust solvent vapor to the outside of the apparatus to keep the drying conditions of wet coats on cylindrical base member uniform immediately after dip-coating. As the result, this apparatus can form thin coats of 30 to 300 $\mu$m thick (containing solvent just after coating) with almost no unevenness in thickness.

The apparatus of the present invention can select any solvent in a wide saturated vapor pressure range of 0.7 to 80 kPa and form coats of less unevenness in thickness.

The present invention uses photoconductive cylindrical base member which are well-known as the electrophotographic sensitive members and any kind of coating liquids to form photo-sensitive coats on said cylindrical base member as far as they are well known in the art. For example, the photo-sensitive layers such as foundation, charge generation, and charge transfer layers are formed respectively from foundation, charge generation, and charge transfer coating liquids. Naturally, this apparatus can use coating liquids to form the other photo-sensitive layers such as intermediate and surface layers.

Generally, the present invention can use any coating liquid solvent as far as it is an organic solvent to be used to form an organic photo-sensitive layer. Concretely, such solvents can be selected, for example, from halogenated hydrocarbons such as methylene chloride, ethers such as tetrahydrofran, alcohols such as ethyl alcohol, and ketones such as cyclohexane.

Below will be explained an embodiment which attains the first object of the present invention.

Embodiment 1

An intermediate layer was formed on respective cylindrical base member in the following procedure:

An intermediate-layer coating liquid was prepared by adding one part (by weight) of polyamide resin CM8000 (fabricated by Toray Industries Inc.) into 10 parts (by weight) of methanol and stirred the mixture to dissolve completely. The coating liquid was put in the simultaneous 4-cylinder dip-coating apparatus having four independent drying hoods each of which has a number of 3 mm-diameter through-holes whose total opening area is 25% of the whole area of the drying hoods and coated four aluminum cylinders (1.0 mm thick×30 mm diameter×340 mm long) at a coating liquid temperature of 24° C., at a pulling-up speed of 480 mm/minute (for pulling the aluminum cylinders from the coating liquid), at a liquid circulation flow rate of 5 liters/minute. The inside diameter of the recycle tube 8 is 150 mm. After passing the coated aluminum cylinders through their own drying hoods of 15 cm long to dry by air, The aluminum cylinders were put in a drying means and dried them up at 70° C. for 10 minutes. With this, an intermediate layer of 0.1 μm thick was obtained. Table 1 shows the unevenness in thickness of the coat formed on each aluminum cylinder. The values in Table 1 are the differences between the maximum and minimum coat thicknesses among sixteen test points on each cylinder (four points spaced at 90 degrees on respective circumferential lines located 20 mm, 50 mm, 160 mm and 300 mm away from the top of the aluminum cylinder). The saturated vapor pressure of methanol at 24° C. is 16 to 18.7 kPa.

COMPARATIVE EXAMPLE 1

Sample coats were made in the same procedure as that of the above embodiment 1 but used a large drying hood instead of the four independent drying hoods. Table 1 also shows the unevenness in thickness of these sample coats.

TABLE 1

| | Unevenness in thickness (μm) | | | | |
|---|---|---|---|---|---|
| | Cylinder No. | | | | |
| Example No. | 1 | 2 | 3 | 4 | Average |
| Embodiment 1 | 0.010 | 0.009 | 0.006 | 0.008 | 0.0083 |
| Comparative example 1 | 0.013 | 0.018 | 0.020 | 0.018 | 0.0173 |

A photo-detection type film thickness measuring system MCPD-1000 (Multichannel Spectrophotometer by Otsuka Electronics Co., Ltd.) was used to measure the thickness of each coated layer.

Embodiment 2

A liquid for coating charge-generation layers were prepared by mixing 60 grams of titanylphthalocyanine Y-form crystal, 700 grams of silicone modified polyvinyl buthyral resin (by Shin-Etsu Chemical Co., Ltd.), and 2,000 milliliters of 2-ethylmethyl ketone (butanone) by a sand mill for 10 hours. This liquid was put in the simultaneous 4-cylinder dip-coating apparatus having four independent drying hoods each of which has a number of 3 mm-diameter through-holes whose total opening area is 25% of the whole area of the drying hoods and coated the aluminum cylinders having an intermediate layer on each of them at a coating liquid temperature of 70° C., at a pulling-up speed of 240 mm/minute (for pulling the aluminum cylinders from the coating liquid), at a liquid circulation flow rate of 5 liters/minute. With this, a charge generation layer of 0.2 μm thick was obtained. The inside diameter of the recycle tube 8 is 150 mm. Table 2 shows the unevenness in thickness of the coat formed on each aluminum cylinder. The values in Table 2 are the differences between the maximum and minimum coat thicknesses among sixteen test points on each cylinder (four points spaced at 90 degrees on respective circumferential lines located 20 mm, 50 mm, 160 mm and 300 mm away from the top of the aluminum cylinder). The saturated vapor pressure of 2-butanone at 24° C. is about 2.3 kPa and the specific gravity of butanone vapor to the air is about 0.81.

COMPARATIVE EXAMPLE 2

Sample charge-generation layers on said intermediate layers were made in the same procedure as that of the above embodiment 2 but used a large drying hood instead of the four independent drying hoods. Table 2 also shows the unevenness in thickness of these sample coats.

TABLE 2

| | Unevenness in thickness (μm) | | | | |
|---|---|---|---|---|---|
| | Cylinder No. | | | | |
| Example No. | 1 | 2 | 3 | 4 | Average |
| Embodiment 2 | 0.005 | 0.008 | 0.009 | 0.010 | 0.0080 |
| Comparative example 2 | 0.015 | 0.010 | 0.012 | 0.018 | 0.0138 |

As seen from Table 1 and Table 2, it is apparent that the intermediate layers and the charge-generation layers formed by a coating apparatus having a multiple of independent drying hoods above the coating bath for coating of a multiple cylindrical base member have by far less unevenness in coat thickness than those formed by a coating apparatus having a large independent drying hood.

A charge transfer layer of 20 μm thick (measured when dried up) was also on the charge generation layer of each cylinder of embodiments 1 and 2 and comparative examples 1 and 2 that already had intermediate and charge-generation layers and thus completed electro-photographic sensitive members. Each of the sensitive members was mounted on a commercially-available electrographic printer, formed test half-tone images on the sensitive member, and evaluated the printed-out half-tone images. As the result, it was observed that the resulting half-tone images obtained from the electro-photographic sensitive members prepared by Embodiments 1 and 2 were excellent without any disturbance. However, the half-tone images obtained from the electro-photographic sensitive members prepared by Comparative Examples 1 and 2 were disturbed.

As apparent from the above embodiments, the electro-photographic sensitive member coating apparatus having a plurality of independent drying hoods in accordance with the present invention can form photo-sensitive and/or intermediate layers of highly even thickness on every cylindrical base member and provide satisfactory cylindrical electro-photographic sensitive members.

Below will be explained the system configuration which attains the second object of the present invention. A system block diagram of a simultaneous multi-cylinder dip-coating apparatus which dips cylindrical base member in a coating liquid, pulls them up from the coating liquid, and thus forms a coating film on each of the cylindrical base member; comprising a bath for storing a coating liquid, a solvent vapor chamber above said bath, and drying hoods above said solvent vapor chamber, wherein said solvent vapor chamber covers the whole space above said bath and exhaust ports are provided between the solvent vapor chamber and the drying hoods over the chamber.

A method of coating electro-photographic sensitive members by said electro-photographic sensitive member coating apparatus, wherein solvent vapor is being exhausted through said exhaust ports while coats are formed on cylindrical base member.

An electro-photographic sensitive member in accordance with the present invention, wherein said sensitive member is prepared by said electro-photographic sensitive member coating method.

A dip-coating apparatus in accordance with the present invention exhausts solvent vapor through an exhaust port provided between the solvent vapor chamber and the drying hoods which are separately provided above the coating bath. This makes the concentration of solvent vapor identical in the whole solvent vapor chamber and lessens unevenness in film thickness. Particularly, even when a solvent of high saturated vapor concentration such as methylene chloride is used, this method can suppress generation of unevenness in film thickness and shorten the length of the leading thin coat area. In other words, an exhaust port provided just above the solvent vapor chamber facilitates exhaust of solvent vapor, and particularly facilitates exhaust of large amount of solvent vapor immediately after dip-coating. Further, this exhaust port can exhaust solvent vapor uniformly from around the cylindrical base member regardless of whether the apparatus is a single-cylinder dip-coating apparatus or a multi-cylinder dip-coating apparatus, keeping the concentration of solvent vapor in the whole solvent vapor chamber uniform.

Therefore, this method can form thin coats of 30 to 300 $\mu$m thick (containing solvent just after coating) with almost no unevenness in thickness and lessen the leading thin coat area.

This method apparatus of the present invention can select any solvent in a wide saturated vapor pressure range of 6.5 to 80 kPa, form coats of less unevenness in thickness, and lessen the leading thin coat area.

Figure 7:
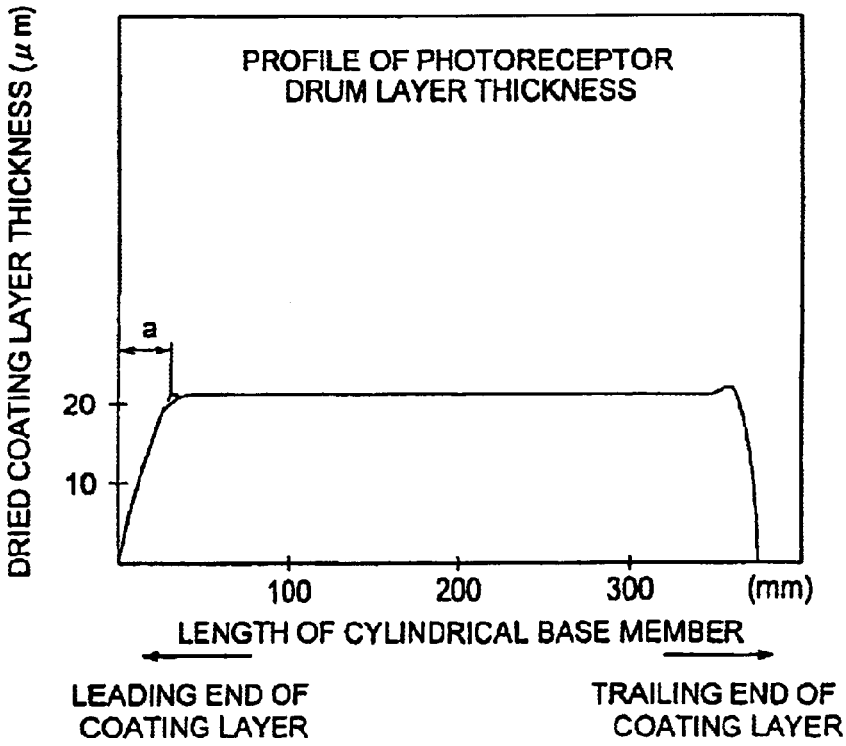
FIG. 7 is a profile of thickness of a charge transfer coat formed on a cylindrical base member.

The "leading thin coat area" here means a thin coat area on the top of the cylindrical base member whose coat becomes thinner as the liquid on the base member immediately after coating gradually flows down by gravity. This phenomenon is found more frequently in coating of charge transfer layers because the layers are thick and dried up slowly. FIG. 7 shows a profile of thickness of a charge transfer coat formed on a cylindrical base member. "a" in FIG. 7 indicates the leading thin coat area.

The present invention can be preferably applied to form organic photo-sensitive layers such as foundation, charge generation, and charge transfer layers. Particularly, the present invention is preferably effective upon coating of charge-transfer layers which are 100 $\mu$m thick and slow to be dried up. Further, the present invention is preferably effective upon simultaneous multi-cylinder dip-coating for simultaneously forming coats on the outer surfaces of a plurality of cylindrical base member. In this case, to exhaust solvent vapor uniformly form around cylindrical base member in the coating liquid bath, the coating bath should be preferably so designed that respective cylindrical base member may be equally arranged in the bath. In other words, the preferred coating liquid bath is cylindrical to simultaneously coat four cylinders as shown in FIG. 3. For a dip-coating apparatus for simultaneously coating five or more cylinders, it is preferred that the cylinders are arranged with an equal distance among them in the bath.

Figure 5:
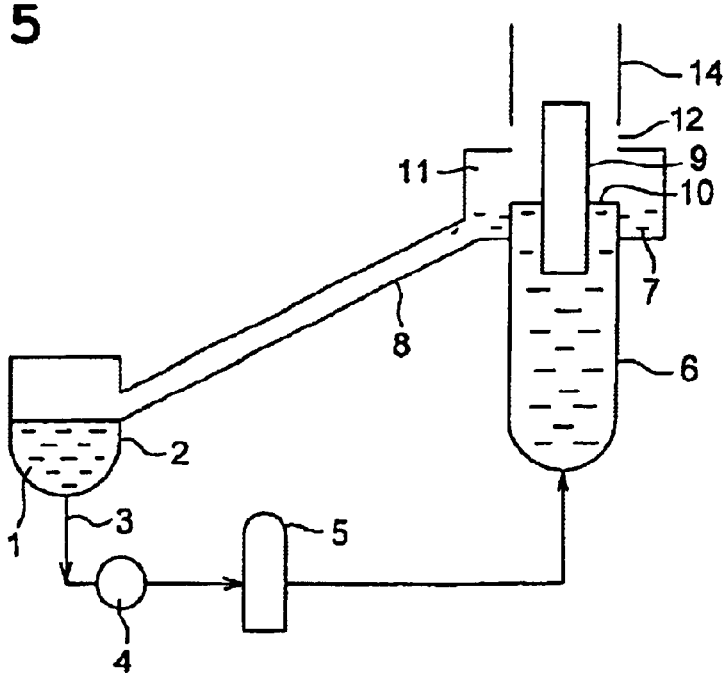
FIG. 5. is a system block diagram of a single-cylinder dip-coating apparatus which is an embodiment of the present invention.

FIG. 5 is a system block diagram of a single-cylinder dip-coating apparatus which is an example of the present invention. IN this figure, the cylindrical base member 9 is dipped in the coating liquid bath 6, coated there, and now being pulled up from the coating liquid. When pulled up from he coating liquid bath 6, the cylindrical base member enter the solvent vapor chamber 11 to let the coated films on the base member emit a lot of solvent vapor, and then enter the drying hood 14 to be dried up (until the coat is not sticky to your fingers). The present invention provides an exhaust port 12 between said solvent vapor chamber 11 and the drying hood 14. This exhaust port can exhaust a lot of solvent vapor while keeping the concentration of solvent vapor uniform in the whole solvent vapor chamber 11 even when a solvent of high saturated vapor pressure is used for the coating liquid or when a coat of 100 $\mu$m or thicker evaporating a lot of solvent vapor is formed. This hole is effective to suppress drying unevenness of coats and increase of the leading thin coat area.

The "solvent vapor chamber" here is a chamber which covers the coating liquid bath, works to hold solvent vapor evaporating from the coating liquid and the coated films, and keeps the concentration of the solvent vapor constant. The drying hood should be preferably 1 to 100 cm high. If the hood is shorter than 1 cm, the effect of the hood becomes little and the generation of unevenness in coat thickness is hardly suppressed.

If the height is greater than 100 cm, the effect of the solvent vapor chamber does not offset the large dimensions of the apparatus.

The exhaust port is provided between the solvent vapor chamber and the drying hood to surround a cylindrical base member which is being pulled up after coating. In other words, it is preferred that said exhaust port 12 is provided between the solvent vapor chamber and the drying hood with a clearance of 0.1 to 10 mm between them. If the clearance is less than 0.1 mm, the solvent vapor is not exhausted sufficiently. If the clearance is more than 10 mm, the solvent vapor in the chamber is exhausted sufficiently but apt to be disturbed by air coming from the outside and the concentration of the solvent vapor in the chamber is apt to be non-uniform.

The ceiling of said solvent vapor chamber has an opening (through-hole) to let a cylindrical base member pass through it. The opening is preferably circular as well as the cylindrical base member.

The drying hood (provided to enclose a cylindrical base member) above the solvent vapor chamber is preferably 5 to 300 cm high.

If the length is shorter than 5 cm, the drying hood has little effect to eliminate uneven coat thicknesses. If the length is longer than 300 cm, the effect of the drying hood does not offset the large dimensions of the apparatus.

Figure 6:
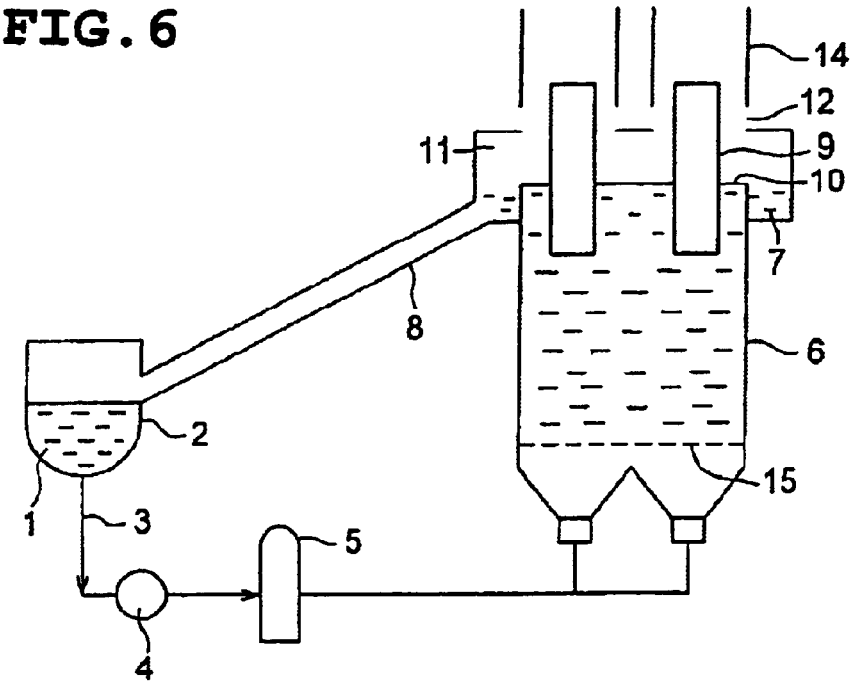
FIG. 6 is a system block diagram of a simultaneous multi-cylinder dip-coating apparatus which is an embodiment of the present invention.

It is preferred that said solvent vapor chamber is equipped with a recycle tube to keep the liquid level of the coating liquid bath constant. FIG. 6 shows a preferred configuration of said solvent vapor chamber with a recycle tube. The coating liquid 1 is transferred by force by the pump 4 from the coating liquid tank 2 to the coating liquid bath 6 through the supply pipe 3 and tire filter 5. The coating liquid bath 6 has a mesh 15 in the lower part of the bath to uniform the velocity of the coating liquid in the bath. The coating liquid supplied into the coating liquid bath 6 overflows down to the coating liquid conduit 7 which is continuously provided on the lower part of the solvent vapor chamber 11, runs into the recycle tube 8, and goes back to the coating liquid tank 2. This liquid circulating means transfers the coating liquid in loop during dip-coating to keep the level 10 of the coating liquid in the coating liquid bath constant irrespectively of whether the cylindrical base member are dipped in the bath or pulled up from the bath. Further, an exhaust port 12 to exhaust solvent vapor is provided above the solvent vapor chamber and higher than the liquid level of the coating liquid bath. A drying hood 14 is provided above the solvent vapor chamber 11 to prevent the solvent vapor from being disturbed by air coming from the outside.

Without the exhaust port 12 or when the exhaust port 12 is provided in the recycle tube 8 below the coating liquid level 10 (as described in Japanese Non-examined Patent Publication H08-220786), the solvent vapor cannot be exhausted fully from the solvent vapor chamber 11 and remains stagnant in the drying hood in case a solvent of high saturated vapor pressure such as methylene chloride is used or in case a coat of 100 $\mu$m or thicker evaporating a lot of solvent vapor is formed. As the result, this causes coat dry-up unevenness and increases the leading thin coat area. However, the present invention provides the exhaust port 12 above the solvent vapor chamber and higher than the coating liquid level 10. Therefore, even when a solvent of high saturated vapor pressure is used, the solvent vapor can be exhausted uniformly from around the cylindrical base member. This port is effective to suppress drying unevenness of coats and increase of the leading thin coat area.

FIG. 6 is a system block diagram of a simultaneous multi-cylinder dip-coating apparatus which is an embodiment of the present invention. IN this figure, cylindrical base member are being pulled up from the coating liquid bath. The coating liquid 1 is transferred by force by the pump 4 from the coating liquid tank 2 to the coating liquid bath 6 through the supply pipe 3 and the filter 5. The coating liquid bath 6 has a mesh 15 in the lower part of the bath to uniform the velocity of the coating liquid in the bath. The coating liquid supplied in to the coating liquid bath 6 overflows down to the coating liquid conduit 7 which is continuously provided on the lower part of the solvent vapor chamber 11, runs into the recycle tube 8, and goes back to the coating liquid tank 2. This liquid circulating means transfers the coating liquid in loop during dip-coating to keep the level 10 of the coating liquid in the coating liquid bath constant irrespectively of whether the cylindrical base member are dipped in the bath or pulled up from the bath. Further, the solvent vapor chamber is provided above the coating liquid bath and a plurality of drying hoods are provided above the solvent vapor chamber. An exhaust port 12 hoods to exhaust solvent vapor. The exhaust port is provided higher than the coating liquid level.

For simultaneous dip-coating of multiple cylinders, it is possible that the drying hoods are provided on the solvent vapor chamber with the same bailey structure as that of the solvent vapor chamber. However, to keep the concentration of solvent vapor near each cylindrical base member identical, it is preferred that the drying hoods are provided one-to-one for the cylindrical base member.

FIG. 6 shows an example of arrangement of independent drying hoods provided one-to one for the cylindrical base member.

Further it is preferred that each drying hood has a number of through-holes to exhaust solvent vapor during drying.

The ratio of the total opening area of said through-holes (to the whole area of the drying hood) is preferably 5 to 70%. If this ratio is less than 5%, the solvent vapor is slow to be exhausted. If this ratio is more than 70%, it is difficult to control the drying speed.

Below will be explained an embodiment which attains the second object of the present invention.

Embodiment 3

An intermediate-layer was formed on respective cylindrical base member in the following procedure:

An intermediate-layer coating liquid 1 was prepared by adding one part (by weight) of polyamide resin CM 8000 (fabricated by Toray Industries Inc.) into 10 parts (by weight) of methanol and stirred the mixture to dissolve completely. The coating liquid 1 was put in the dip-coating apparatus of FIG. 5 and coated an aluminum cylinder (1.0 cm thick×30 mm diameter×340 mm long) at a coating liquid temperature of 24° C., at a pulling-up speed of 480 mm/minute (for pulling the aluminum cylinders from the coating liquid), at a liquid circulation flow rate of 1 liter/minute. The exhaust port 12 is provided between the solvent vapor chamber and the drying hood with a clearance of 1 mm therebetween. The exhaust port is a circular hole of 50 mm in diameter 10 cm high above the coating liquid level. The inside diameter of the recycle tube 8 is 100 mm. After passing the coated aluminum cylinder through the drying hood of 15 cm long to dry by air, the aluminum cylinder was put in a drying means and dried up at 70° C. for 10 minutes. With this, an intermediate layer of 0.1 $\mu$m thick was obtained.

A liquid for coating charge-generation layers was prepared by mixing 60 grams of titanylphthalocyanine Y-form crystal, 700 grams of silicone modified polyvinyl buthyral resin (by Shin-Etsu Chemical Co., Ltd.), and 2,000 milliliters of 2-ethylmethyl ketone (butanone) by a sand mill for 10 hours.

This coating liquid was put in the dip-coating apparatus to FIG. 5 and coated the aluminum cylinder having an intermediate layer on it (prepared by Embodiment 3) at a pulling-up speed of 480 mm/minute (for pulling the aluminum cylinder from the coating liquid), at a coating liquid temperature of 24° C., and at a liquid circulation flow rate of 1 liter/minute. The exhaust port 12 is provided between the solvent vapor chamber and the drying hood with a clearance of 1 mm therebetween. The exhaust port is a circular hole of 50 mm in diameter 10 cm high above the coating liquid level. The inside diameter of the recycle tube 8 is 100 mm.

Next, a charge-transfer layer was formed on the charge generation layer of the above aluminum cylinder. A liquid for coating charge-transfer layers was prepared by dissolving 225 grams of [N-(4-methylphenyl)-N-{4-(β-phenylstyryl)phenyl}-p-toluidine], 300 grams of polycarbonate (viscosity-average molecular weight: 20,000), and 6 grams of antioxidant (exemplified compound 1-3), into 2,000 ml of dichloromethane. This coating liquid was applied to said charge generation layer by a dip-coating method and got a charge-transfer layer of 20 $\mu$m thick (measured when dried). The aluminum cylinder was pulled up at a speed of 240 mm/minute from the coating liquid. The temperature of the coating liquid is 24° C. The exhaust port is provided between the solvent vapor chamber and the drying hood with a clearance of 1 mm therebetween. The exhaust port is a circular hole of 50 mm in diameter 10 cm high above the coating liquid level. The flow rate of the coating liquid in circulation is 1 liter/minute. The inside diameter of the recycle tube is 100 mm. The coated aluminum cylinder was passed through the drying hood of 15 cm long to dry by air, put the half-dried aluminum cylinder in a drying means and dried it up at 90° C. for 60 minutes. With this, an electro-photographic sensitive member was obtained. The above steps were repeated to prepare four samples. Table 3 shows their unevenness of thickness. The values in Table 3 are the differences between the maximum and minimum coat thicknesses among sixteen test points on each sample cylinder (four points spaced at 90 degrees on respective circumferential lines located 20 mm, 50 mm, 160 mm and 300 mm away from the top of the aluminum cylinder). The saturated vapor pressure of dichloromethane is 46.6 kPa at 24° C. and the specific gravity of dichloromethane vapor to the air is about 1.326.

COMPARATIVE EXAMPLE 3

A charge transfer layer was formed on said charge generation layer in the same procedure as that of the above Embodiment 3 but the exhaust port is provided on the recycle tube 8 below the coating liquid level. Table 3 also shows the unevenness in thickness of these sample coats.

TABLE 3

| | Unevenness in thickness (μm) | | | | |
|---|---|---|---|---|---|
| | Repetition No. | | | | |
| Example No. | 1 | 2 | 3 | 4 | Average |
| Embodiment 3 | 0.42 | 0.40 | 0.45 | 0.54 | 0.4525 |
| Comparative example 3 | 0.80 | 0.68 | 0.70 | 0.84 | 0.7550 |

Embodiment 4

Four cylinders were coated with the intermediate layer coating liquid prepared in Embodiment 3 by a simultaneous 4-cylinder dip-coating apparatus of FIG. 6 and Fig. 3. (FIG. 3 shows the arrangement of four cylindrical base member to be dip-coated simultaneously.) The aluminum cylinders were pulled up at a speed of 400 mm/minute from the coating liquid. The temperature of the coating liquid is 24° C. The exhaust port 12 is provided between the solvent vapor chamber (see FIG. 6) and the drying hoods with a clearance of 1 mm therebetween. The exhaust port is a circular hole of 50 mm in diameter 10 cm high above the coating liquid level. The flow rate of the coating liquid in circulation is 5 liters/minute. The inside diameter of the recycle tube is 150 mm. The coated aluminum cylinders were passed through their drying hoods of 15 cm long to dry by air, put them in the drying means and dried it up at 70° C. for minutes.

With this, an intermediate layer of 0.1 μm thick was obtained.

Four cylinders were coated respectively having an intermediate layer with the charge-generation layer coating liquid by a simultaneousl 4-cylinder dip-coating apparatus of FIG. 6 and FIG. 3.

The aluminum cylinders were pulled up at a speed of 480 mm/minute from the coating liquid. The temperature of the coating liquid is 24° C. The exhaust port 12 is provided between the solvent vapor chamber (see Fig. 6) and the drying hoods with a clearance of 1 mm therebetween. The exhaust port is a circular hole of 50 mm in diameter 10 cm high above the coating liquid level. The flow rate of the coating liquid in circulation is 5 liters/minute. The inside diameter of the recycle tube is 150 mm. The coated aluminum cylinders were passed through their drying hoods of 15 cm long to dry by air, put them in the drying means and dried it up until the coat is not sticky to the fingers. With this, a charge generation layer of 0.5 μm thick (measured when dried up) was obtained.

The cylinders respectively having a charge generation layer were coated with the charge-transfer layer coating liquid (same as that used in Embodiment 3) by the dip-coating method and got a charge-transfer layer of 20 μm thick (measured when dried up). the four aluminum cylinders were pulled up simultaneously at a speed of 240 mm/minute from the coating liquid. The temperature of the coating liquid is 24° C. The exhaust port 12 is provided between the solvent vapor chamber (see FIG. 6) and the drying hoods with a clearance of 1 mm therebetween. The exhaust port is a circular hole of 50 mm in diameter 10 cm high above the coating liquid level. The flow rate of the coating liquid in circulation is 5 liters/minute.

The inside diameter of the recycle tube is 150 mm. The coated aluminum cylinders were passed through their drying hoods of 15 cm long to dry by air, put them in the drying means and dried them up at 90° C. for 60 minutes. Thus, electro-photographic sensitive members containing the charge-transfer layer was obtained.

Table 4 shows the unevenness in thickness of these sample coats. The values in Table 6 are the differences between the maximum and minimum coat thicknesses among sixteen test points on each cylinder (four points spaced at 90 degrees on respective circumferential lines located 20 mm, 50 mm, 160 mm and 300 mm away from the top of the aluminum cylinder).

COMPARATIVE EXAMPLE 4

A charge transfer layer was formed on said charge generation layer in the same procedure as that of the above embodiment 4 but the exhaust port is provided on the recycle tube 8 below the coating liquid level. Table 4 also shows the unevenness in thickness of these sample coats.

Embodiment 5

A charge transfer layer was formed on said charge generation layer in the same procedure as that of the above embodiment 4 but the exhaust port 12 has a clearance of 8 mm. Table 4 shows the result of evaluation.

Embodiment 6

A charge transfer layer was formed on said charge generation layer in the same procedure as that of the above embodiment 4 but the exhaust port 12 has a clearance of 0.2 mm. Table 4 shows the result of evaluation.

Table 5 shows the results of evaluation of the leading thin coat areas of the electro-photographic sensitive members of Embodiments 4 to 5 and Comparative example 4.

Evaluation of the Leading Thin Coat Areas

Measure the thickness of a coat on the coated cylinder, at intervals of 10 mm along a selected longitudinal line from the top to the bottom of the cylinder, plot the results of measurement, and create the thickness profile of the cylinder as shown in FIG. 7. The length (L) of the leading thin coat area is defined as a length "a" between the Y-axis and an intersection of the tangentialline of the rise of the profile and the extension of the saturated thickness. Table 5 lists the length of leading think coat area of each electro-photographic sensitive member. A photo-detection type film thickness measuring system MCPD-1000 (Multi-channel Spectrophotometer by Otsuka Electronics Co., Ltd.) was used to measure the thickness of each coated layer.

TABLE 4

| | Unevenness in thickness (μm) | | | | |
|---|---|---|---|---|---|
| | Cylinder No. | | | | |
| Example No. | 1 | 2 | 3 | 4 | Average |
| Embodiment 4 | 0.44 | 0.42 | 0.53 | 0.44 | 0.46 |
| Embodiment 5 | 0.46 | 0.48 | 0.45 | 0.42 | 0.45 |
| Embodiment 6 | 0.43 | 0.48 | 0.46 | 0.45 | 0.46 |
| Comparative example 4 | 0.67 | 0.68 | 0.75 | 0.75 | 0.712 |

TABLE 5

| | Length of the leading thin coat area (mm) | | | | |
|---|---|---|---|---|---|
| | Cylinder No. | | | | |
| Example No. | 1 | 2 | 3 | 4 | Average |
| Embodiment 4 | 12.3 | 13.6 | 11.6 | 12.9 | 12.60 |
| Embodiment 5 | 16.3 | 17.2 | 13.8 | 14.9 | 15.55 |
| Embodiment 6 | 10.3 | 11.6 | 9.7 | 9.9 | 10.38 |
| Comparative example 4 | 25.6 | 28.6 | 24.2 | 26.8 | 26.30 |

As seen from Table 3 to Table 5, the electro-photographic sensitive member coating apparatus of the present invention comprising a solvent vapor chamber above the coating liquid bath and a solvent vapor exhausting port between the solvent vapor chamber and the drying hoods improves the problems of thickness unevenness and the leading thin-coat-area problems more drastically than the conventional dip-coating apparatus having a solvent vapor exhausting port in the recycle tube.

As seen from the above embodiments, the apparatus and method of dip-coating electro-photographic sensitive members in accordance with the present invention can suppress generation of unevenness in film thickness and shorten the length of the leading thin coat area. Therefore, the present invention can provide excellent cylindrical electro-photographic sensitive members.

What is claimed is:

1. A coating apparatus comprising:

a common coating tank to store a coating liquid;

a dipping device to lift down a plurality of base members into the coating liquid of the common coating tank and to lift up the plurality of base members above the coating liquid so that the plurality of base members are coated simultaneously with the coating liquid of the common coating tank; and a plurality of drying hoods corresponding in number to the plurality of base members and provided above the common coating tank so that each of the plurality of base members is lifted up from the common coating tank into a respective drying hood among the plurality of base members, and at least one of the drying hood has a plurality of vent holes.

2. The coating apparatus of claim 1, wherein when the coated base passes through the drying hood, a gap between the drying hood and the base member is 0.1 to 1.0 times of the diameter of the base member.

3. The coating apparatus of claim 1, wherein each drying hood of the plurality of drying hoods is provided with a plurality of vent holes.

4. The coating apparatus of claim 1, wherein the diameter of each of the plurality of vent holes is 0.1 to 10 mm.

5. The coating apparatus of claim 1, wherein the ratio of the total opening area of the plurality of vent holes to the entire area of the drying hood is 5 to 50%.

6. The coating apparatus of claim 1, wherein the base member is covered with a coating layer having a thickness of 5 μm to 300 μm.

7. The coating apparatus of claim 1, further comprising:

a common solvent vapor collecting chamber provided above the common coating tank, wherein the common solvent vapor collecting chamber has plural openings corresponding in number to the plurality of drying hoods so that the plurality of drying hoods are located above a corresponding opening.

8. The coating apparatus of claim 1 for a plurality of light sensitive members each for use in an electrophotography, wherein the base members are cylindrical.

9. The coating apparatus of claim 1, wherein each of dry hoods is provided so as to have a gap between the surface of coating liquid and the dry hood being 1 cm to 100 cm.

10. A coating apparatus comprising:

a coating tank to store a coating liquid;

a solvent vapor collecting chamber provided above the coating tank to enclose a top of the coating tank and having an opening to allow a base member to pass through the opening;

a dry hood provided above the opening and having an inner passage to allow the base member to pass through the dry hood;

a dipping device to lift down the base member into the coating liquid through the inner passage and the opening and to lift up the base member above the dry hood through the inner passage of the dry hood; and a discharging port capable to discharge solvent vapor in the solvent vapor collecting chamber, the discharging port being provided between the opening and the dry hood in a direction perpendicular to a direction lifting up and down of the base member.

11. The coating apparatus of claim 10, wherein the width of the discharging port between the solvent vapor collecting chamber and the dry hood is 0.1 to 10 mm.

12. The coating apparatus of claim 10, wherein the discharging port has a circumferential length of 50 to 100% of that of the drying hood.

13. The coating apparatus of claim 10, further comprising:

a recycling line connected to the solvent vapor collecting chamber so as to collect a coating liquid overflowing from the coating tank and to recycle the collected coating liquid.

14. The coating apparatus of claim 10, wherein the base member is covered with a coating layer having a thickness of 30 μm to 300 μm.

15. The coating apparatus of claim 10, wherein the coating liquid contains a solvent having a saturated vapor pressure of 6.5 to 80 kPa at 24° C.

16. The coating apparatus of claim 10 for a plurality of light sensitive members each for use in an electrophotography, wherein the base members are cylindrical.

17. A coating apparatus comprising:

a coating tank to store a coating liquid;

a dry hood to dry the coating liquid on the base member at the position above the coating tank and the dry hood having an inner passage to allow the base member to pass through the dry hood, and the dry hood having a length of 5 to 300 cm; and a dipping device capable to lift down the base member into the coating liquid through the inner passage and capable to lift up the base member.

18. The coating apparatus of claim 17, comprising a solvent vapor collecting chamber provided above the coating tank.

19. The coating apparatus of claim 18, wherein the solvent vapor collecting chamber has an opening to allow a base member to pass through the opening, and wherein the dipping device is capable to lift down the base member into the coating liquid through the inner passage and the opening and capable to lift up the base member.

20. The coating apparatus of claim 19, wherein the dry hood is provided to the coating liquid on the base member at the position above the solvent vapor collecting chamber.

21. The coating apparatus of claim 20, comprising a discharging port capable to discharge solvent vapor provided between the solvent vapor collecting chamber and the dry hood.

22. The coating apparatus of claim 21, wherein the discharging port is provided between a position higher than level of the coating liquid and the dry hood.

23. The coating apparatus of claim 17, wherein a plurality of the dry hoods corresponding in number to a plurality of base members are provided.

* * * * *